US008459471B2

(12) United States Patent
Mobley

(10) Patent No.: US 8,459,471 B2
(45) Date of Patent: Jun. 11, 2013

(54) SLIP FREE ARTICLE DISPLAYS

(76) Inventor: Tammy J. Mobley, Bremen, GA (US)

( * ) Notice: Subject to any disclaimer, the term of this patent is extended or adjusted under 35 U.S.C. 154(b) by 803 days.

(21) Appl. No.: 11/266,640

(22) Filed: Nov. 3, 2005

(65) Prior Publication Data

US 2006/0201825 A1 Sep. 14, 2006

Related U.S. Application Data

(60) Provisional application No. 60/594,065, filed on Mar. 8, 2005, provisional application No. 60/595,514, filed on Jul. 12, 2005.

(51) Int. Cl.
*A47F 7/02* (2006.01)

(52) U.S. Cl.
USPC ..... 211/85.2

(58) Field of Classification Search
USPC ..... 211/85.2, 13.1; 206/6.1, 45.14, 566, 206/523, 564
See application file for complete search history.

(56) References Cited

U.S. PATENT DOCUMENTS

| | | | | |
|---|---|---|---|---|
| 1,096,616 | A | | 5/1914 | Feuerstein |
| 3,209,903 | A | | 10/1965 | Shiffman |
| 3,482,705 | A | | 12/1969 | Bushey |
| 3,482,780 | A | | 12/1969 | Bushey |
| 3,613,873 | A | | 10/1971 | Schulman |
| 3,645,403 | A | | 2/1972 | Walters |
| 4,043,477 | A | | 8/1977 | Deese |
| 4,300,674 | A | | 11/1981 | Davet |
| 4,341,300 | A | * | 7/1982 | Roy ..... 248/520 |
| 4,406,372 | A | | 9/1983 | Bell |
| 4,685,568 | A | | 8/1987 | Elsfelder |
| 4,732,269 | A | * | 3/1988 | Roy ..... 206/751 |
| 4,907,704 | A | | 3/1990 | Souders |
| 4,913,289 | A | | 4/1990 | Feiler |
| 5,009,333 | A | | 4/1991 | Souders |
| 5,031,758 | A | * | 7/1991 | Gonzalez ..... 206/6.1 |
| 5,062,526 | A | | 11/1991 | Rudnick et al. |
| 5,176,263 | A | | 1/1993 | Caruso |
| 5,316,153 | A | | 5/1994 | Crawford et al. |
| 5,377,820 | A | | 1/1995 | Christman |
| 5,649,625 | A | | 7/1997 | Ovadia |
| 5,677,507 | A | | 10/1997 | Becker et al. |
| 5,775,484 | A | * | 7/1998 | Ovadia ..... 206/6.1 |
| 5,957,274 | A | | 9/1999 | Ovadia |
| 5,967,326 | A | | 10/1999 | Tessler et al. |

(Continued)

FOREIGN PATENT DOCUMENTS

| | | |
|---|---|---|
| CN | 1083686 A | 3/1994 |
| CN | 2642160 | 9/2004 |

(Continued)

OTHER PUBLICATIONS

"Gunther Mele Exclusive Ring Tray Displays", www.gunthermele.com/index2.htm, Apr. 6, 2007, 1 page.

(Continued)

*Primary Examiner* — Darnell Jayne
*Assistant Examiner* — Stanton L Krycinski
(74) *Attorney, Agent, or Firm* — Woodcock Washburn LLP

(57) ABSTRACT

A non-slip jewelry display having a tacky top surface such that jewelry items cling to the display in a frictional fashion; thereby preventing shifting or sliding of the jewelry item on the display when moved or otherwise jolted about.

9 Claims, 4 Drawing Sheets

U.S. PATENT DOCUMENTS

| | | | | |
|---|---|---|---|---|
| 6,000,592 | A | 12/1999 | Clanin | |
| 6,006,899 | A | 12/1999 | McAuley et al. | |
| 6,056,130 | A | 5/2000 | Ovadia | |
| 6,059,115 | A | 5/2000 | Ovadia | |
| 6,078,557 | A | 6/2000 | Pierson | |
| 6,205,688 | B1 | 3/2001 | Grosser-Samuels | |
| 6,244,431 | B1 | 6/2001 | VanFleet | |
| 6,471,053 | B1 * | 10/2002 | Feibelman | 206/6.1 |
| 6,471,077 | B1 | 10/2002 | Johnson | |
| 6,494,316 | B1 * | 12/2002 | Bloch et al. | 206/45.2 |
| 6,673,409 | B1 | 1/2004 | Wheatley | |
| 6,758,330 | B1 * | 7/2004 | Chudada | 206/6.1 |
| 6,866,143 | B2 | 3/2005 | Ovadia | |
| 6,874,619 | B1 * | 4/2005 | Hawkes | 206/6.1 |
| 6,959,890 | B1 | 11/2005 | Breitinger | |
| 7,757,844 | B2 | 7/2010 | Mobley | |
| 2004/0031702 | A1 | 2/2004 | Mangano | |
| 2004/0060879 | A1 * | 4/2004 | Cohen | 211/85.2 |
| 2004/0069676 | A1 * | 4/2004 | Ovadia | 206/566 |
| 2005/0183983 | A1 * | 8/2005 | Ovadia | 206/566 |
| 2005/0269216 | A1 | 12/2005 | Ovadia | |
| 2006/0201824 | A1 | 9/2006 | Mobley | |
| 2006/0201825 | A1 | 9/2006 | Mobley | |
| 2006/0201826 | A1 | 9/2006 | Mobley | |
| 2007/0175772 | A1 * | 8/2007 | Cunningham | 206/6.1 |
| 2007/0227929 | A1 | 10/2007 | Mauerhan et al. | |
| 2008/0023357 | A1 * | 1/2008 | Whiteis | 206/316.1 |
| 2008/0197028 | A1 * | 8/2008 | Cerato | 206/6.1 |
| 2008/0251396 | A1 * | 10/2008 | Oh | 206/6.1 |

FOREIGN PATENT DOCUMENTS

| | | | |
|---|---|---|---|
| CN | 101170922 | A | 4/2008 |
| WO | WO 93/22949 | | 11/1993 |
| WO | WO 2006/096248 | | 9/2006 |
| WO | WO 2006/096261 | | 9/2006 |

OTHER PUBLICATIONS

International Patent Application No. PCT/US06/02289: International Search Report and Written Opinion of the International Searching Authority, dated Sep. 10, 2007, 5 pages.

International Patent Application No. PCT/US06/03410 International Search Report and Written Opinion of the International Searching Authority, dated Jul. 26, 2007, 5 pages.

International Patent Application No. PCT/US06/03410: International Preliminary Report on Patentability, dated Sep. 12, 2007, 5 pages.

International Patent Application No. PCT/US06/02289: International Preliminary Report on Patentability dated Sep. 25, 2007, 5 pages.

* cited by examiner

SLIP FREE ARTICLE DISPLAYS

PRIORITY CLAIM TO RELATED US APPLICATIONS

The benefit of provisional application No. 60/594,065, filed on Mar. 8, 2005, provisional application No. 60/595,514, filed on Jul. 12, 2005, and regular application Ser. No. 11/252,534, filed on Oct. 18, 2005 are claimed.

TECHNICAL FIELD

The present version of the invention relates generally to display devices, and more specifically to a non-slip jewelry display for releasably securing a jewelry item thereto; thereby, preventing movement, displacement or shifting of the jewelry item thereover while in transport.

BACKGROUND

Displays are used to present articles and entice consumers based on their aesthetic appearance, realistic or artistic presentation of an article. Display cases, lighting, mirrors, display forms and the like are used together to display articles in a realistic setting, such as presenting the article as a consumer would see themselves using the article. After attracting the consumer to the display, a sales person often removes and returns selected displays from a display case in order to present the selected article to a consumer for close up inspection. Slipping and shifting of the article as well as realignment of bumped displays while transporting such display distracts the consumer from the sales presentation.

Jewelry display devices such as boards, ramps, humps, pedestals, platforms, t-bars, forms, and/or the like are typically constructed of a material having an outer surface such as linen, velvet, flock, faux leather (Vienna™), faux suede, Lucite™, silk, burlap, Plexiglas™, and/or acrylic. Unfortunately, such surfaces are often slick and present problems when used for displaying jewelry. For example, when a sales person removes a jewelry display article from a display case or counter, or bumps neighboring displays while attempting to remove such displays, the jewelry item(s) that have been bumped or set in motion often slide off the display and into the display area. Indeed, returning such jewelry items to their appropriate displays each time a jewelry item is displaced becomes burdensome and time consuming.

Accordingly, various attempts to resolve the foregoing disadvantages have been proposed. Most notably, special mechanical u-pins are forced into the jewelry display to secure the jewelry item to the display. Such pins make it difficult for the sales person to quickly remove the jewelry item from the display and allow the consumer to handle the item. In addition, special displays and mounts have been created to mechanically hold the jewelry item within or on the display, such as displays with built-in ring slots, simulated fingers and wrists, and displays with earring holes for mounting earrings. Moreover, conventional adhesive such as tacky glues and/or tapes have been used to secure jewelry items to a jewelry display, however, the chemical bond either damages the object on which it was used, or leaves a residue on the jewelry item that is difficult to remove without damaging or devaluing the jewelry items. Similarly, there are also magnetic devices in which two pieces of a magnet are secured to the jewelry display and the jewelry item, and then magnetically coupled together. Moreover, hook-and-loop fasteners often require that the two functional portions of the fastener be adhered to the surfaces of the objects, and then fastened together; thus, subjecting the object's respective surfaces to potential damage. However, none of the foregoing products provide a jewelry display device comprising a non-slip surface and, as such, absent the requisite mechanical element, such devices would function inefficiently in maintaining the jewelry item in a selected position.

Therefore, for the foregoing reasons, it is readily apparent that there is a need for a non-slip jewelry display or material that functions to releasably secure a jewelry item thereto and, thereby, prevent movement of the jewelry item there over while in transport.

BRIEF DESCRIPTION

Briefly described in a preferred embodiment, the present version of the invention overcomes the above-mentioned disadvantages and meets the recognized need for such an invention by providing a non-slip surface jewelry display for releasably securing a jewelry item to a jewelry display; thereby, preventing movement, displacement or shifting of the jewelry item there over when in transport.

According to its major aspects and broadly stated, the present version of the invention in its preferred form is a non-slip surface jewelry display, comprising a display platform and a non-slip high friction surface material disposed over or placed thereon.

More specifically, the preferred embodiment of the present version of the invention is a slip free article display for releaseably securing jewelry items to the surface of a jewelry display without altering the jewelry item surface, yet allowing for ready retrieval of the jewelry display without causing the jewelry item to dislodge therefrom. Preferably, the varying forms of each display platform function to simulate and display the selected jewelry item in actual use such as a wrist, neck, or chest form. As such, non-slip high friction surface material is laminated, glued or otherwise affixed to display platform creating a jewelry display, whereon a jewelry item is place, thus, releasably securing such jewelry item to such jewelry display. In addition, it should be recognized that the present system and method may be selectively utilized for the retention and display of any selected article.

Accordingly, a feature and advantage of the present version of the invention is its ability to expedite jewelry-handling processes by reducing or eliminating slippage of jewelry items from their jewelry displays during movement and/or alignment.

Another feature and advantage of the present version of the invention is its ability to reduce slippage of jewelry items from their jewelry displays during movement and/or transport to overnight storage or vaulting procedure; thereby expediting jewelry display take-down time.

Still another feature and advantage of the present version of the invention is its ability to reduce or eliminate the need to realign or readjust displayed jewelry when working within the spatial constraints of a jewelry display case or counter.

Yet another feature and advantage of the present version of the invention is the provision of a selected material that comprises physical characteristics enabling contouring, bending and conforming to the surface of various display platforms.

Still yet another feature and advantage of the present version of the invention is the provision of a selected material that comprises physical characteristics enabling indicia to be formed in the material including a logo, an advertisement, an instruction, a promotion, a company name, or a product name.

These and other features and advantages of the present version of the invention will become more apparent to one skilled in the art from the following description and claims when read in light of the accompanying drawings.

BRIEF DESCRIPTION OF THE DRAWINGS

The present version of the invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

In describing the preferred and selected alternate embodiments of the present version of the invention, as illustrated in FIGS. 1-5, specific terminology is employed for the sake of clarity. The present version of the invention, however, is not intended to be limited to the specific terminology so selected, and it is to be understood that each specific element includes all technical equivalents that operate in a similar manner to accomplish similar functions.

Referring now to FIGS. 1-5, the present version of the invention in its preferred embodiment is a slip free article display 10, in which an article is releasably secured to display 10 preventing movement, displacement or shifting of the article when transporting display 10 with such article disposed thereon.

Figure 1:
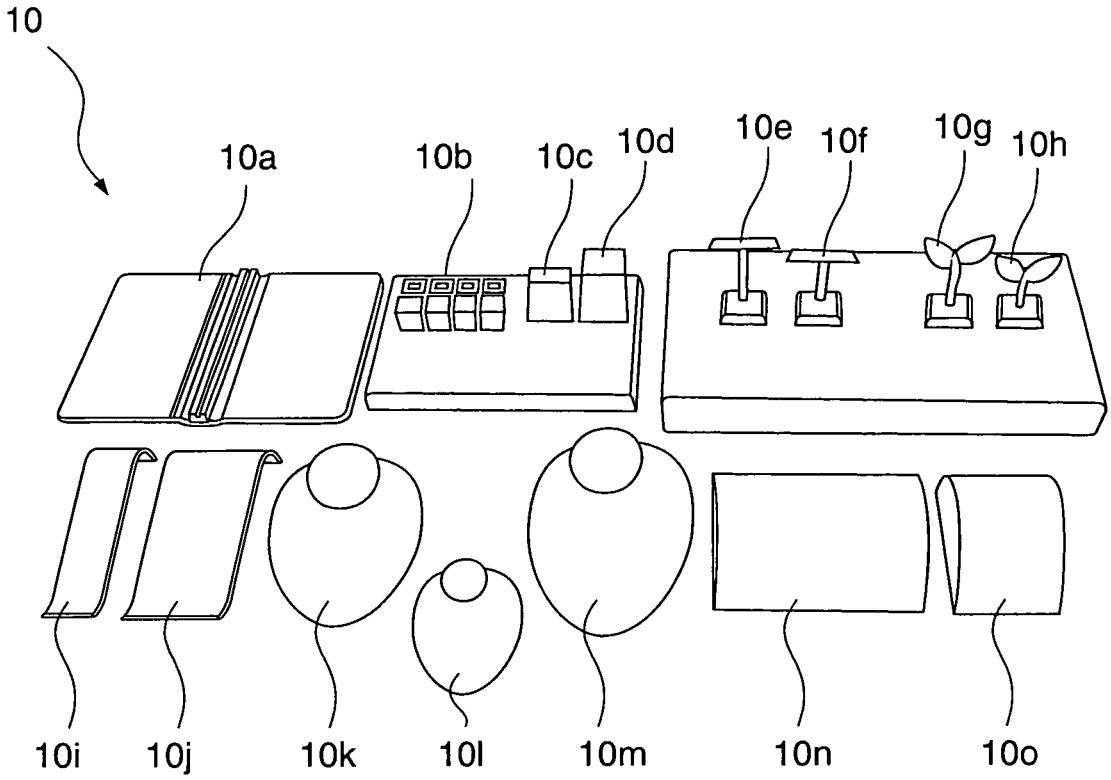
FIG. 1 is a perspective view of plurality of jewelry displays according to a preferred embodiment of the present version of the invention.

Referring now to FIG. 1, by way of example, and not limitation, there is illustrated a perspective view of display 10 comprising a fifteen (15) piece set of various jewelry display forms. However, display 10 may be manufactured or otherwise fabricated to comprise any suitable structural configuration that facilitates the retention and display of any selected jewelry item 40 thereon. More specifically, display 10*a* may comprise a display pad preferably used to provide a back drop for displaying jewelry item J. Display 10*b* may comprise a slotted ring tray module preferably for displaying items such as individual and/or multiple rings. Displays 10*c* and 10*d* are wedge displays. Displays 10*e* and 10*f* are display T-bars bars, and displays 10*g* and 10*h* are display trees, each used to display items such as bracelets. Display 10*i* and 10*j* are S-curved ramps preferably for displaying items such as watches and/or bracelets. Display 10*k*, 101 and 10*m* are neck forms preferably used to display items such as necklaces. Display 10*n* and 10*o* are hump displays preferably used to display items such as watches and/or bracelets. Individually each display 10*a* through 10*o* comprises the functional equivalent of display 10 and shall be represented herein as display 10.

Figure 2:
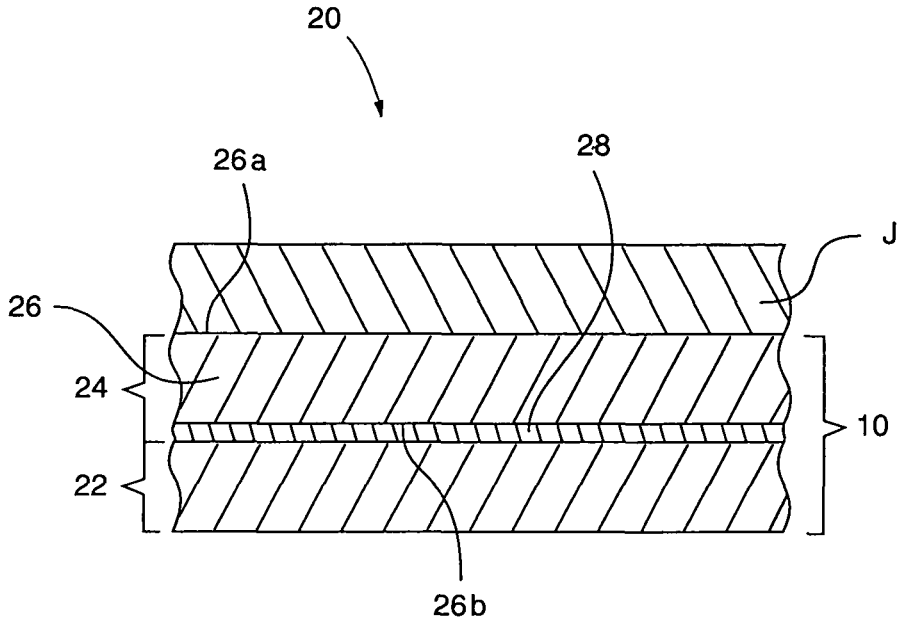
FIG. 2 is a detailed, partial cross-sectional view a slip free jewelry display according to a preferred embodiment of the present version of the invention.

Referring now to FIG. 2, there is illustrated a partial cross-sectional view of display 10. Preferably, display 10 comprises display platform 22 and non-slip high friction surface fabric 24 disposed over or placed thereon display platform 22. Platform 22 is preferably constructed of plastic, as plastic offer a variety of forms and shapes; however, other suitable materials such as cardboard, Styrofoam, wood, metal, aluminum, or the like, can be utilized, provided such material has sufficient strength and/or durability as would meet the purpose described herein. More specifically, platform 22 comprises any structural form or configuration including, but is not limited to jewelry display forms 10*a* through 10*o*, as set forth in FIG. 1.

Fabric 24 preferably comprises woven backing 28 and frictional material 26. Woven backing 28 is laminated, glued or otherwise affixed to friction holding material 26, normally by bringing it and material 26 together with such binder applied to bottom surface 26*b* of material 26, or with such binder applied both to bottom surface 26*b* of material 26 and to top surface 28*a* of woven backing 28, and thereafter curing the binder. The selected binder may be Star Flake Cake Glue, vegetable-based, non-toxic glue; however, any suitable adhesive can be utilized provided it has sufficient holding properties, such as 3M Super 77 Multi Purpose Adhesive. Woven backing 28 preferably imparts dimensional stability to display 10, and increases the adhesion of non-slip fabric 24 to jewelry display form 22.

Woven backing 28 preferably includes woven, non-woven, open weave, closed weave tape yarns and/or fill yarns as such fabric combines low cost with adequate dimensional stability. The polymer types used to make the tapes and fill yarns may include polypropylene, polyester (PET and PTT), polyamide, polyethylene, polyamides, and/or acrylics. Blends of fibers may also be utilized.

Frictional material 26 preferably has a top surface 26*a* and bottom surface 26*b*. Top surface 26*a* is preferably constructed to frictionally (mechanical specific adheration) and securely hold one or more jewelry items J despite movement of display 10. That is frictional material 26 is preferably "tacky", such that the jewelry items J cling to upper surface 26*a* in a mechanical fashion as opposed to a chemical or adhesive manner; thereby preventing jewelry items J from sliding off jewelry display 10.

Frictional material 26 is preferably constructed of an expanded vinyl material or polyurethane material; however, any suitable material can be utilized provided it has sufficient mechanical grip, mechanical specific adheration, and/or high frictional properties. Expanded vinyl material and polyurethane provide good mechanical specific adheration, coefficient frictional or "tacky" quality that retains the jewelry items J thereon without damaging the surface of the jewelry. Frictional material 26 is preferably a single layer material that comprises the requisite coefficient of friction and further comprises other physical properties that enable frictional material 26 to be otherwise molded or shaped to conform to the underlying platform 22 and further allow frictional material 26 to be otherwise laminated or adhered to platform 22.

Friction is a resistive force that prevents two objects from sliding freely against each other. The coefficient of friction ($f_r$) is a number that is the ratio of the resistive force of friction ($F_r$) divided by the normal or perpendicular force (N) pushing the objects together. It is represented by the equation:

$$f_r = F_r / N.$$

In the alternative, frictional material 26 can be formed of multiple layers with different materials. More specifically, frictional material 26 can include without limitation: diisodecy/phlthalate; polymeric plasticer; UV stabilizer(s); vinyl shear stabilizer(s); blowing agent(s) for vinyl plastisol; and/or vinyl resin (plastic). Frictional material 26 may comprise a weight between approximately 15 and approximately 25 ounces per square foot; more preferably between approximately 17 and approximately 23 ounces per square foot; and most preferably between approximately 19 and approximately 21 ounces per square foot. Frictional material 26 may have a thickness between approximately 0.4 and approximately 1.0 millimeter; more preferably between approximately 0.55 and approximately 0.95 millimeter; and most preferably between approximately 0.65 and approximately 0.85 millimeter.

It will be appreciated that frictional material 26 in use in a jewelry display cases is subjected to and preferably withstands extreme conditions, such as heat and sunlight, fading, cracking, or bleaching. In addition, it will be appreciated that frictional material 26 preferably withstands standard cleaning solutions such as soap and water without fading, cracking, or loss of luster or tackiness. Moreover, frictional material 26 preferably is re-useable, in that, jewelry item J may be repeatedly placed upon frictional material 26 and repeatedly removed therefrom without losing its frictional or "tacky" quality that retains the jewelry items J thereon. Moreover, no damaging or reactive residues are transferred to jewelry item J when placed upon and removed from jewelry display 10. Further, jewelry item J did not chemically interact with display 10, nor did damage or tarnishments to the surface of jewelry item 40 occur. More specifically, in use such frictional material 26 passed the Pearl Nacre Test; that is placement and removal of jewelry item J (a pearl) from display 10 did not cause the nacre of the pearl to peel or change colors.

Figure 3:
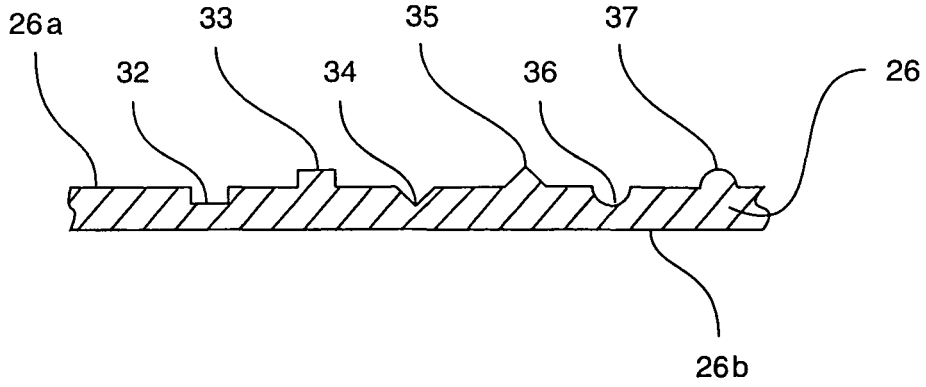
FIG. 3 is a detailed, partial cross-sectional view of slip free jewelry display in accordance with a preferred embodiment of the present version of the invention.

Referring now to FIG. 3, there is illustrated a partial cross-sectional view of an alternative embodiment display 10. As illustrated in FIG. 3, an array or matrix of a plurality of indentations 32, 34, and/or 36 or protrusions 33, 35, and/or 37 can be formed in upper surface 26*a* of frictional material 26, thereby creating a plurality of indentations 32, 34, and/or 36 or protrusions 33, 35, and/or 37 thereon to increase or decrease the total surface area of upper surface 26*a* that contacts with jewelry item J when display 10 is in use. Indentations 32, 34, and/or 36 or protrusions 33, 35, and/or 37 can be straight, rounded, linear, curvilinear or recta-linear to create a surface configured to be aesthetically pleasing and/or luxurious or similar to that of leather or suede.

Figure 4:
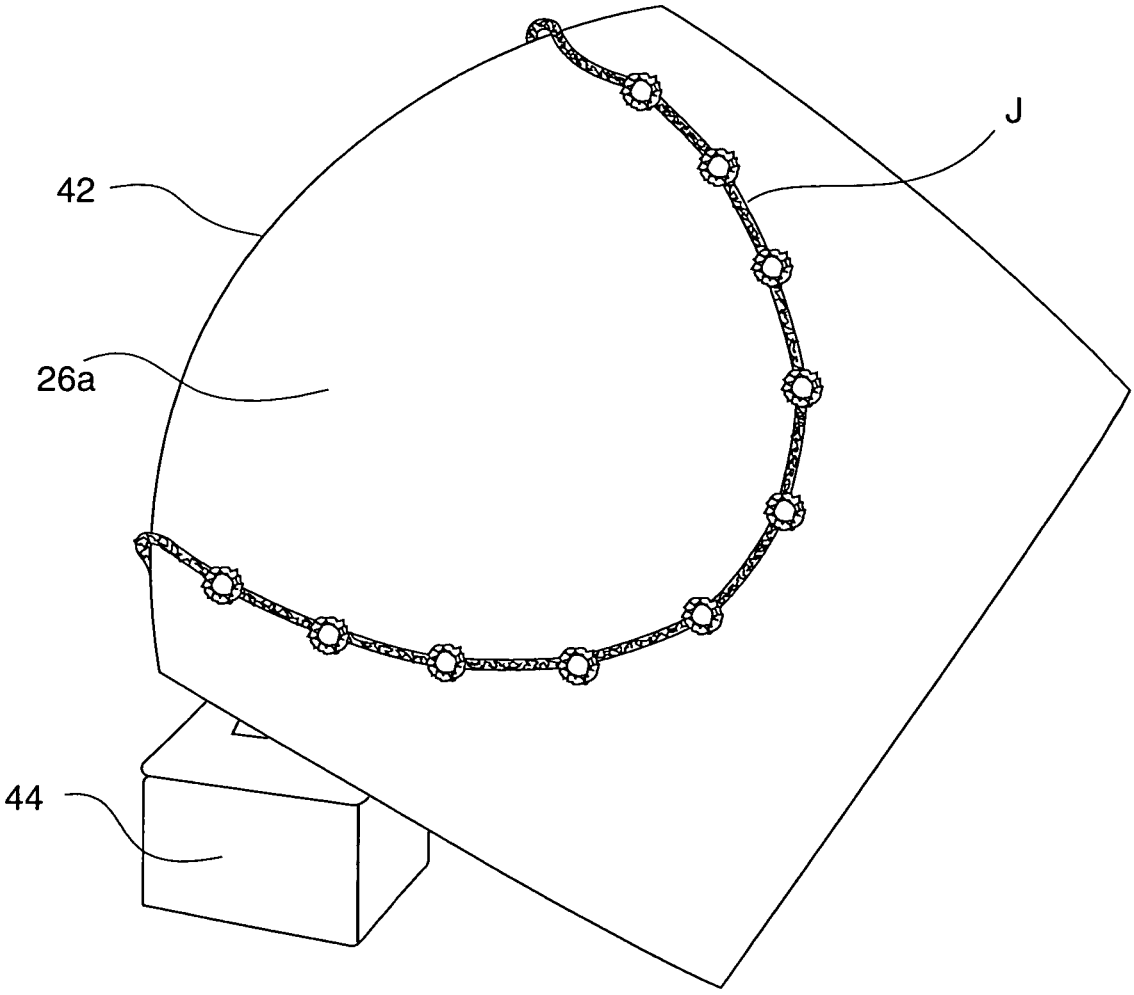
FIG. 4 is a perspective view of a slip free jewelry display in accordance with a preferred embodiment of the present version of the invention.

Referring now to FIG. 4, there is illustrated a perspective view of a pedestal board style jewelry display 42 in accordance with a preferred embodiment of the present version of the invention. As illustrated in FIG. 4, non-slip fabric 24 preferably can be bent, formed or molded to cover various platforms 22, such as the displays 10 set forth in FIG. 1. Jewelry item J is placed on upper surface 26*a* of frictional material 26, wherein jewelry item J is displayed and/or offered for sale while being securely held in place by the frictional forces of frictional material 26.

Frictional material 26 also can include indicia 46 formed on upper surface 32 of frictional material 26, including embossing or de-bossing such indicia 46. Indicia 44 can be formed by ink, or ink-like materials, printed on upper surface 26*a*. Indicia 44 can be a label or business card adhered by frictional material 26 to jewelry display 42. Indicia 44 can include but is not limited to: a logo, an advertisement, an instruction, a promotion, a company name, and a jewelry item J name. Thus, frictional material 26 can be used as a promotional item by including a business name or product logo jewelry display 42 or in general on display 10.

Figure 5:
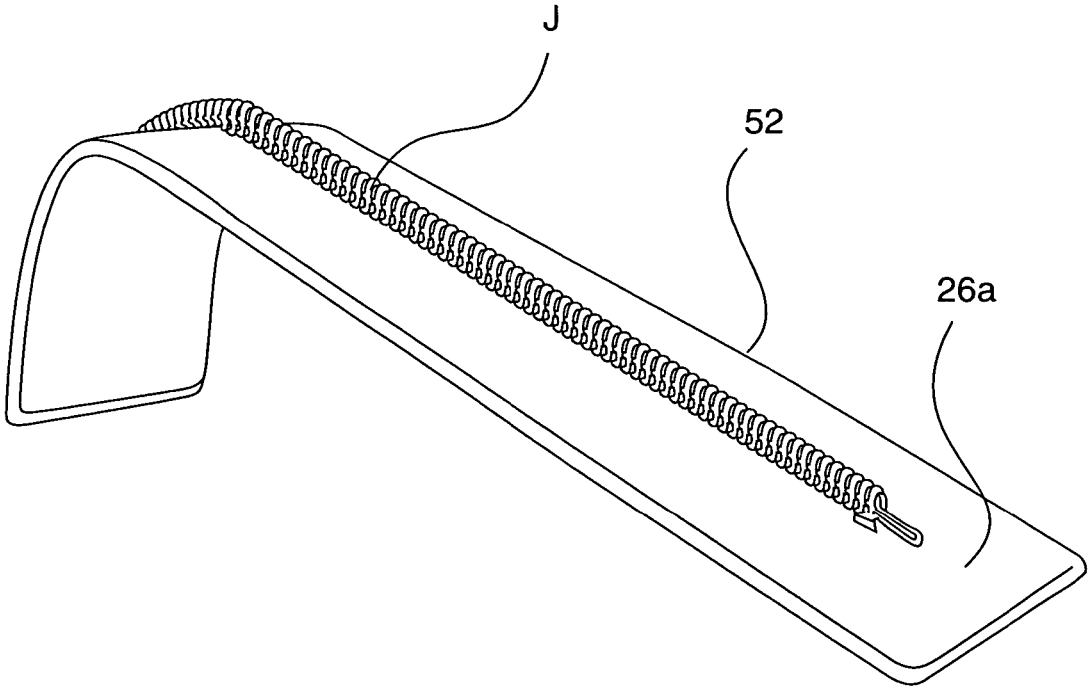
FIG. 5 is a perspective view of a slip free jewelry display in accordance with a preferred embodiment of the present version of the invention.

Referring now to FIG. 5, there is illustrated a perspective view of a ramp jewelry display 52 according to a preferred embodiment of the present version of the invention. As illustrated in FIG. 5, non-slip fabric 24 preferably can be bent, formed or molded to cover various platforms 22, such as displays 10*i* or 10*j* set forth in FIG. 1. Jewelry item J is placed on upper surface 26*a* of frictional material 26, wherein jewelry item J is displayed and/or offered for sale while being securely held in place by the frictional forces of frictional material 26. Ramp jewelry display 52 preferably is used to display jewelry item J such as watches and/or bracelets.

Jewelry items J shall include, but not be limited to, ornamental devices worn by persons, typically made of stones, precious and semiprecious gems, and metals including watches, bracelets, necklaces, rings, and earrings, as well as items such as hair ornaments or body piercing jewelry. It is appreciated that other items can be selectively secured to frictional material 26 and displayed and/or offered for sale.

Test Data

Samples of jewelry display products currently on the market, which are covered by or made from materials, such as linen, velvet, faux leather, faux suede, silk, and acrylic (Competing Materials), were purchased for comparison testing. Single bracelet or watch S-curved ramps, with a ramp slope of 6-9 degrees, and made from a Competing Material, were selected for comparison testing. S-curved ramp jewelry display 52 covered with frictional material 26 were tested side-by-side in both a vertical and horizontal movement test.

The vertical displacement test consisted of placing the same bracelet B (same weight, shape and style) in the same position on jewelry display 52 and placing jewelry display 52 in the same position on a flat tray placed on a table. Thereafter, the flat tray was elevated by lifting one edge of the tray corresponding to the elevated section of the jewelry display 52 until the bracelet B slid off jewelry display 52. The angles reached when the bracelet B slid off test jewelry display 52 were recorded. Table I summarizes the results of the vertical displacement test and the elevation in degrees when each jewelry display lost its grip of the bracelet.

TABLE 1

Vertical Displacement Test

| Material | Degrees |
|---|---|
| Jewelry Display 52 | 90 |
| Faux Suede | 35 |
| Velvet | 35 |
| Faux Leather | 33 |
| Linen | 28 |
| Silk | 25 |
| Acrylic | 23 |

The horizontal displacement test consisted of placing the same bracelet B (same weight, shape and style) in the same position on jewelry display 52 and placing jewelry display 52 in the same position on a flat tray placed on a table. Thereafter, the flat tray was elevated by lifting one edge of the tray corresponding to the left side of the jewelry display 52 until the bracelet slid off the display. The angles reached when the bracelet slid off the test jewelry display 52 were recorded. Table II summarizes the results of the horizontal displacement test and the elevation in degrees when each jewelry display lost its grip of the bracelet.

TABLE II

| Horizontal Displacement Test | |
|---|---|
| Material | Degrees |
| Jewelry Display 52 | 80 |
| Faux Leather | 28 |
| Velvet | 23 |
| Silk | 23 |
| Linen | 22 |
| Faux Suede | 22 |
| Acrylic | 18 |

It is clear from the data of both the vertical displacement test and the horizontal displacement test that the frictional material 26 of the present version of the invention comprises a gripping power much greater than the gripping power of the Competing Materials.

Display 10 with frictional material 26 expedite the jewelry handling process by reducing or eliminating slippage of jewelry item J from display 10 during movement, during transport to overnight storage or vaulting procedures, or due to bumping of displays when reaching into the display area during sales presentations. Such jewelry handling process may include, but is not limited to, jewelry display set up time, take down time, and alignment and/or adjustments.

It is contemplated that any non-slip high friction material can be applied to jewelry display 10 using an aerosol dispenser, dispenser pump, or other pressurized system, to propel thereover a mixture of the aerosol and such material. The aerosol propellant may include, but is not limited to liquefied chlorofluorocarbon (CFC), liquefied hydrofluoroalkanes (HFA), air, or any other substitute propellant that is capable of being propelled with such material onto jewelry display 20 via an aerosol dispenser system. In addition, it is contemplated that such material can be applied to jewelry display 10 using extrusion, extrusion coating, extrusion laminating, dipping or any other coating or laminating system.

Having thus described exemplary embodiments of the present version of the invention, it should be noted by those skilled in the art that the within disclosures are exemplary only, and that various other alternatives, adaptations, and modifications may be made within the scope of the present version of the invention. Accordingly, the present version of the invention is not limited to the specific embodiments illustrated herein, but is limited only by the following claims.

What is claimed is:

1. A slip free jewelry display for removably securing a selected jewelry item thereon, said display comprising:

a display platform; and a flexible mechanical specific adheration surface for removably and releasably retaining the jewelry item thereon, the mechanical specific adheration surface comprising material selected from the group consisting of expanded vinyl and polyurethane material, and wherein said surface is tacky and includes a plurality of indentations and protrusions, wherein said mechanical specific adheration surface is laminated to at least a portion of said display platform and wherein the mechanical specific adheration surface has a frictional coefficient sufficient to substantially prevent movement of the jewelry item by clinging to the jewelry item without damaging the jewelry item when the display is moved.

2. The jewelry display in accordance with claim 1, further comprising indicia formed on said surface, said indicia being selected from the group consisting of a logo, an advertisement, an instruction, a promotion, a company name, a jewelry product name, and combinations thereof.

3. A slip free jewelry display for removably securing a jewelry item, said display comprising:

a bendable mechanical specific adheration material including a plurality of indentations and protrusions, said material selected from the group consisting of expanded vinyl and polyurethane material, wherein said material clings to the jewelry item without damaging the jewelry item; and a jewelry display platform, wherein said material is affixed to said platform by a backing layer affixed between said platform and said material, and wherein the mechanical specific adheration material is tacky by virtue of having a frictional coefficient sufficient to substantially prevent movement of the jewelry when the display is moved.

4. The jewelry display in accordance with claim 3, further comprising indicia formed on said material, said indicia being selected from the group consisting of a logo, an advertisement, an instruction, a promotion, a company name, a jewelry product name, and combinations thereof.

5. The jewelry display of claim 1, wherein said display platform comprises a neck form.

6. The jewelry display of claim 1, wherein said display platform comprises an S-curved ramp.

7. The jewelry display of claim 1, wherein said display platform comprises a wedge display.

8. The jewelry display of claim 1, wherein said display platform comprises a slotted ring tray module.

9. The jewelry display of claim 1, wherein said display platform comprises a display pad.

* * * * *